US006651369B1

(12) United States Patent
Keating et al.

(10) Patent No.: US 6,651,369 B1
(45) Date of Patent: Nov. 25, 2003

(54) RETAIL-SHELF UNIVERSAL SIGN-HOLDER POUCH

(75) Inventors: Kenneth W. Keating, San Diego, CA (US); Pamela S. Tagariello, San Diego, CA (US)

(73) Assignee: Ken Keating, Oceanside, CA (US)

( * ) Notice: Subject to any disclaimer, the term of this patent is extended or adjusted under 35 U.S.C. 154(b) by 0 days.

(21) Appl. No.: 08/882,463

(22) Filed: Jun. 25, 1997

(51) Int. Cl.[7] ..... G09F 3/20
(52) U.S. Cl. ..... 40/658; 40/661.03
(58) Field of Search ..... 40/661.03, 661.08, 40/658, 648, 654, 661, 775, 776

(56) References Cited

U.S. PATENT DOCUMENTS

| | | | | |
|---|---|---|---|---|
| 2,650,444 A | * | 9/1953 | Coyle et al. | 40/661 |
| 2,859,546 A | * | 11/1958 | Gutterson | 40/658 |
| 2,981,081 A | * | 4/1961 | Hopp et al. | 40/661.03 |
| 3,530,605 A | | 9/1970 | Gutterson | |
| 3,548,523 A | | 12/1970 | Laws | |
| 3,711,973 A | * | 1/1973 | Slavsky | 40/658 |
| 4,165,890 A | * | 8/1979 | Leff | 40/654.01 |
| 4,602,447 A | * | 7/1986 | Feingold | 40/776 |

* cited by examiner

*Primary Examiner*—Cassandra H. Davis
(74) *Attorney, Agent, or Firm*—Inventech; R. W. VonHeck

(57) ABSTRACT

An improved attention getting inexpensive brandsign apparatus adapted to existing retail-store merchandise-isle shelf-face pricing-channer use, wherein a special transparent flexisle plastic envelope-pocket uniquely combines a tab like appendage for insertion into the vertical receiver-slot of a standard existing slider-clip. The new more durable, convenient, and attractive planar sign-holder generally momprises two-layers of vinyl-sheeting material fused-together about three perimeter-sides, thereby forming a readily accessible pocket;—facilitating quick and easy recurrent substitution of sales-information exhibited therewithin upon a double-faced paper placard. The new sign-holder being universally suited to perpendicular-flag type mounting-clips, includes a substantially rigid plastic insert-tab portion, preferably featuring opposed special stabilizing-chamfers arranged at the upper and lower outer terminuses, which act to maintain a desired more orderly appearing vertical attitude installation of the pocket. Also set forth are genetic-variations of the inert-tab, including rounded terminus; and a version having an adhesion substrate with an avulsable cover-strip, whereby the insert-tab can be made attachable to any sales-placard or separate view-pocket.

18 Claims, 1 Drawing Sheet

FIG.-1A
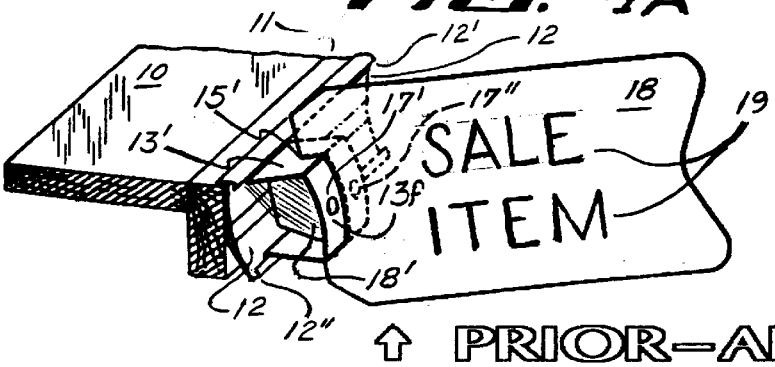
FIG.-1B
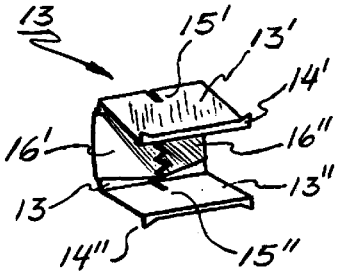
PRIOR-ART
FIG.-2
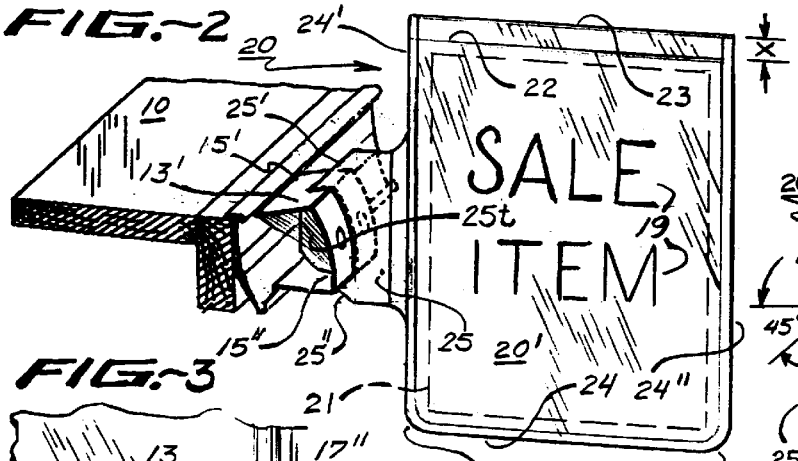
FIG.-4
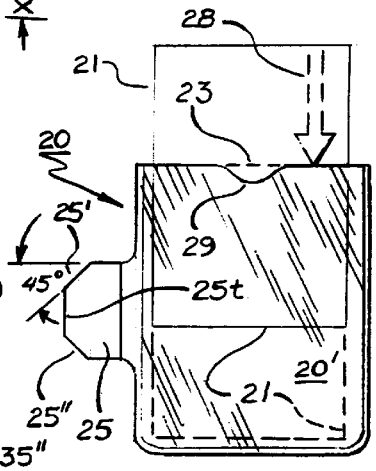
FIG.-3
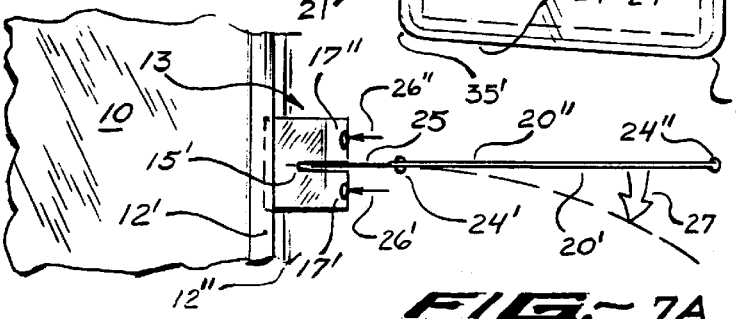
FIG.-5
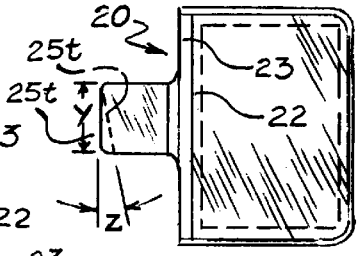
FIG.-6A
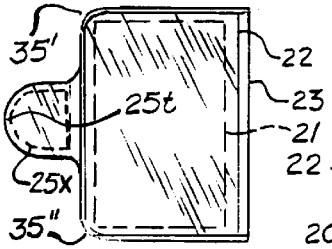
FIG.-7A
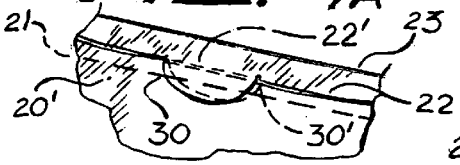
FIG.-7B
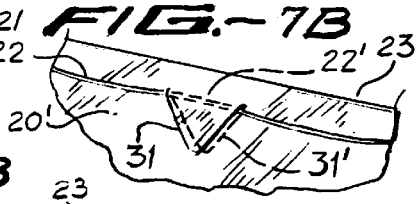
FIG.-7C
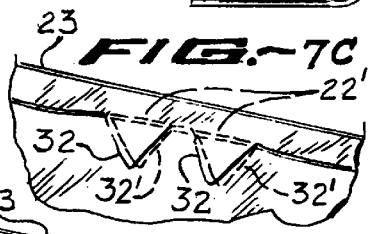
FIG.-6B
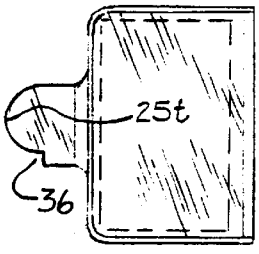
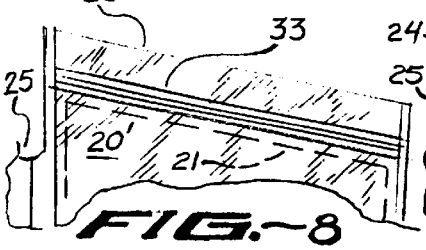
FIG.-8
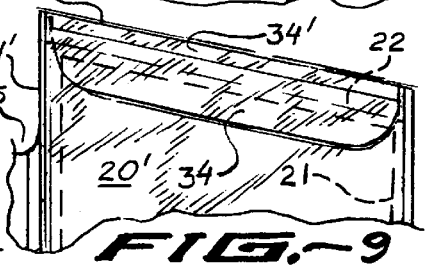
FIG.-9

RETAIL-SHELF UNIVERSAL SIGN-HOLDER POUCH

I.) BACKGROUND OF INVENTION

1. Field of Invention

This invention relates to sales-placard holder apparatus sometimes referred to as retail-store merchandise-isle brand-sign "shelf-talkers"; and more particular, it relates to those devices facilitating shelf-face pricing-channel mounting installation.

2. Prior-Art History

Background research discovery provides some interesting prior patent-art regarded as germane to this disclosure, chronologically for example U.S. Pat. No. 3,530,605(filed: May 1968) sets forth a currently very popular spring-clip device having bifurcated-legs with vertically-opposed paws which snap into an existing linear pricing-channel usually set on a 15–20 degree tilted-back attitude relative to the vertical as to improve visual reading by a passing shopper. The stainless-steel spring-clip has a vertical retention-slot wherein a folded-paper (or cover-stock) or sheet-plastic sales-placard (sometimes having an insert-tongue portion) is manually inserted and retained via two integrally formed horizontally-opposed heavily-sawtoothed pincher-jaws; and lends itself nicely to the purposes of this invention disclosure. A similar display-clip of injection-molded plastic is also commercially available, which likewise snaps into the horizontal-rail pricing-channel, and acts to similarly pinch-grip display-card placards.

In U.S. Pat. No. 3,537,196(filed: July 1968) is shown another type of shelf-edge display sign device, which employs horizontally-opposed wire-formed retention-springs by which to achieve secure mounting into the horizontal pricing-channel; but is not considered currently popular, nor does it lend itself to the purposes of this invention disclosure.

In U.S. Pat. No. 3,548,523(filed July 1968) is shown a device having three spaced-apart vertical bifurcated-clips, for perpendicular frictional holding of a removable slide-out pocket-like protective transparent-plastic envelope, into which is placed a paper-card having some manner of indicia imprinted thereon. However, the finger-like bifurcated-clips obscure a substantial portion of the desirably viewable indicia, and would not be adaptable to shelf-edge display mounting.

In U.S. Pat. No. 4,338,739(filed February 1981) is shown a signage device for linear pricing-channel installation, wherein a sheet-plastic member has die-cut opposed wing-like portions which clip-in to the existing horizontal pricing-channel. The device is adaptable to either parallel series-placard display, or the sales-placard may be held perpendicularly out from the shelf via an adhesive-tab applied along the inward vertical edge of the sales-placard; for viewing from either direction of travel down the merchandise-isle. However, when time comes for change of the many exhibited (generally weekly special) sales-placards, the display clerk necessarily just disposes of the entire holder devices and attached sales-placards, owing to the time-consuming procedure necessarily involved in changing the mentioned adhesive substrate.

In U.S. Pat. No. 4,995,182 (filed July 1988) is shown a die-cut device which folds along score-lines for attachment along a retail-store shelf edge, as to hold a sales-placard perpendicularly outward from the shelf; the holder of which attaches to the shelf either via adhesive, or via depressable-tang retention devices engaging into shelf-top perforations.

In U.S. Pat. No. 5,263,269(filed September 1989) is shown a 2-piece injection-molded plastic shelf edge "holder device for sheet or strip shaped information carriers"; the holder device being attached to the shelf's frontal-edge via double-face adhesive-tape, while the insertable indicia sales-placard is located between the two-layers of plastic, the outermost layer being of transparent-plastic. However, the holder and others, such as U.S. Pat. No. 5,375,803 & No. 5,473,833, are not adaptable thereto to an arrangement whereby the sales-placard could be held outward into the merchandise-isle at a right-angle relative to the shelf's front edge.

Therefore, in full consideration of the preceding patent review, there is determined a need for an improved form of device to which these patents have been largely addressed. The instant inventors hereof believe their newly improved sales-placard holder device, commercially referred to as the MAX-IMPACT™ Signer, currently being developed for production under auspices of the MaxIMPACt-Mfg./Mkt.Co., exhibits certain advantages as shall be revealed in the subsequent portion of this instant disclosure.

II.) SUMMARY OF THE INVENTION

A.) In view of the foregoing discussion about the earlier invention art, it is therefore important to make it pellucid to others interested in the art that the object of this invention is to provide a more convenient reusable sales-placard holder apparatus for retail-store merchandise-isle shelf-face linear pricing-channel installation;—wherein is provided a transparent-plastic pocket having an offset-tab facilitating manual insertion into an existing currently popular channel-clip's retention-slot (of the type substantially according to the previously described U.S. Pat. No. 3,530,605).

The flexible transparent-plastic two-layer sheeting material may be of polyethylene or other suitable thin plastic material, but is preferably die-cut from vinyl sheeting to any preferred size, and marginally seated together along three of it's four parallelpied edges the fourth edge being an open-edge providing interstitial access thereto, enabling convenient insertion of a sales-placard therein for displaying of merchandise related timely sales-information viewable from either direction of merchandise-isle travel by shoppers.

B.) Another object of this invention disclosure is to set forth a sales-placard holder article as described in previous item-A, and wherein the offset-tab extends in a parallel manner from one of the mentioned edging margins, for insertion into the heretofore sales-placard pinching retention-slot. That is, the empty channel-clip is now caused to hold upon a substantially more durable offset-tab portion of the pocket, where formerly the horizontally-opposed heavily-sawtoothed pincher-jaws (employed just behind the retention-slot of the channel-clip) acted directly upon the generally paper or cover-stock sales-placard. While the pocket portion is preferably fabricated from approximately 0.009-gauge flexile vinyl, it is preferred that the insert-tab portion be die-cut from a single layer of approximately 0.019-gauge substantially more rigid type vinyl material. The effect of the more rigid character quality of the insert-tab is to establish a more solid positioning of the insert-tab relative to the channel-clip's insert-slot;—yet the pocket portion remains free to flex-aside from it's normal position extending perpendicularly out at a right-angle from the supporting shelf-face.

An alternate generic-variant embodiment of the insert-tab portion, is to fabricate the insert-tab as a contiguous die-cut portion of the pocket's two opposed half portions, then inserting a third piece of more rigidizing vinyl-plastic only between the die-cut portions defining the insert-tab, which tends to give the sawtooth-jaws of the pre-existing channel-clip slightly better bite into the softer skin opposed outer layers of the insert-tab portion (as compared to the unlaminated previously described insert-tab construction of a single-layer of approximately 0.019-guage material. In any case, when the offset-tab portion is made to a substantially more rigid type quality construction, permanently bonded with the more flexile pocket body material, it facilitates easier manual insertion into the channel-clip's pinching retention slot;—the more rigid material better resisting the rigors of said retention-slot's pinching action, while maintaining the pocket portion perpendicularly outset from the existing merchanidise-shelf.

C.) Another object of this invention disclosure is to set forth a sales-placard holder article as described in previous items-A&B, and wherein the offset-tab portion can be formed planar but in several generic-variant configurations. For example, the presently preferred configuration is an outward extension from the double layered pocket body portion, whereby the basic squared or square-cut outermost terminus portion of said inert-tab is preferably provided with outwardly tapered upper and lower distal edges. Hence, the insert-tab's leading insertion-edge can thusly be made more easily insertable into the channel-clip's retention-slot without manual fumbling. In this configuration, the insertion-edge portion of the insert-tab is approximately half the breadth of the insert-tab's opposite pocket joining edge portion, which is approximately half the breadth of the pocket's adjoining edge. An advantage of this insert-tab formation resides in the lower preferably 45-degree cut tending to abut against the lower edge of the channel clip's retention-slot; thereby lending a supporting effect to maintain the insert-tab and adjoining pocket securely in installed position, for a neat appearing array of displayed pockets.

Another generic-variation of the insert-tab's insertion-edge terminus formation is made "canted" to an angle tapering slightly toward the bottom region of the pocket portion. It has been found that this slanted taper cut of the insert-tab causes the pocket portion to automatically stand or assume a more perpendicular attitude relative to the floor-surface of the merchandise-isle when the outer terminus portion is installed abutingly into an existing standard and generally slightly tilted (approximately 15–20 degrees from vertical) channel-clip as is dictated by the normally slightly canted existing pricing-channel molding.

Another generic-variant of the insert-tab's insertion-edge formation is made with an arched outermost terminus abuting portion, preferably made at an approximate 1-inch radius, thereby enabling the installer or user to thereby variably determine the installed attitude of the pocket portion. Also the described arched insertion-edge terminus may include an abuting-notch located where the lower edge of said arch makes transition into a straight portion which forms an approximate 90-degree angle relative to said pocket portion; the abuting-notch serving to catch on the lower edge of the channel-clip's retention-slot, and thereby more effectively maintain the "as installed" attitude, for an orderly appearing array of pocket holders when signed down-the-line of the store's merchandise-isles.

D.) Another object of this invention disclosure is to set forth a sales-placard holder article comprising a universal insert-tab substantially as described in preceding item-B, excepting that the insert-tab is initially a separate member provided with a vertical adhesive-substrate having a protective avulsive-strip (which the retail-store merchandise-clerk tears away) as to apply the insert-tab to an existing transparent view-pocket, or optionally directly upon the side-margin of a sales-placard. The aggregate sales-placard and insert-tab, or alternately the aggregate viewing-pocket, is then easily insertable into the vertical retention-slot of an existing channel-clip;—thereby displayably holding either the viewing-pocket or sales-placard perpendicularly outset from said shelf-edge pricing-channel. The useful novel configuration of a substantially conventional insert-terminus portion in combination with a conveniently self-adhesive hanger-terminus portion, enables the retail-store merchandise-clerk to assemble an insert-tab configured to their preference.

E.) Another object of this invention disclosure is to provide a sales-placard holding pocket or view-pocket which optionally includes a longer pocket panel having at least one die-cut slit-like closure-tab entity formed to a substantially U-shaped, V-shaped, or W-shaped configuration, and arranged relative to the opposing pocket panel, as that the user may simply press against the lower terminus of the downward pointing (downward toward the top-edge of the opposite pocket panel) closure-tab sufficiently as to cause the closure-tab to to thereby bias over (as in over-lapping) the top-edge terminus opening of the opposite pocket panel. This simple device effectively acts as an opening-stop provision, preventing removal of the sales-placard therefrom until the closure-tab is manually detached from it's impingement in engaged position over the shorter pocket layer panel. This simple provision is easily included during the overall die-cutting procedure, and hence does not really incur added cost to the quantity purchaser; and thus is really preferred over more costly provisions achieving a similar result, such as a full-width downward-flap of the longer panel over the shorter panel, or via a full-width conventional ZipLock® (such as is presently found on various transparent-plastic commercially available retail-food pouches).

III.) DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the Claims section annexed hereto; and accordingly, a better understanding of the invention and the variant uses is intended, by reference to the drawings, which are considered as primarily exemplary and not to be therefore construed as restrictive in nature; wherein:

FIG. 1A, is a pictorial perspective-view of a "prior-art" channel-clip installed in an exemplified pricing-channel;

FIG. 1B, is an alternate rear/elevation-view thereof, showing how the channel-clip's sawtoothed-jaws are typically arranged to pinch tightly upon the insert-tab of an existing one-piece sales-placard;

FIG. 2, is a pictorial perspective-view of the "new-art", favoring the frontal upper-left portion thereof, showing the preferred embodiment as it would substantially appear installed perpendicularly from the merchandise-shelf;

FIG. 3, is an upper/plan-view thereof;

FIG. 4, is a side/elevation-view thereof, showing the sales-placard being inserted interstitially between the two-layers of the pocket portion.

FIG. 5, is a fragmented side/elevation-view showing a genetic-variation thereof, a square-cut terminus and an optional canted terminus.

FIG. 6A, is a fragmented side/elevation-view showing a generic-variation thereof, having an arched terminus;

FIG. 6B, is a fragmented side/elevation-view showing a generic-variation thereof, having an arched terminus with an abutment-notch;

FIG. 7A, is a fragmented side/elevation-view showing a generic-variation thereof, showing the optional die-cut closure-tab of U-shaped configuration;

FIG. 7B, is a fragmented side/elevation-view showing a generic-variation thereof, showing the optional die-cut closure-tab of V-shaped configuration;

FIG. 7C, is a fragmented side/elevation-view showing a generic-variation thereof, showing the optional die-cut closure-tab of W-shaped configuration;

FIG. 8, is a fragmented side-elevation-view showing the generic-variation thereof, showing the optional pocket-closure of conventional plastic-zipper configuration;

FIG. 9, is a fragmented side/elevation-view showing a generic-variation thereof, showing the optional pocket-closure of conventional flap-like configuration.

IV.) ITEMIZED NOMENCLATURE REFERENCES

10—exemplified shelf
11—shelf-face
12,12'/12"—pricing-channel, channel-rails (upper/lower)
13,13'/13",13*f*—overall display-clip, bifurcated-legs (upper/lower), outer face portion
14',14"—clip-paws (upper/lower)
15,15'/15"—clip retention-slot, terminuses (upper/lower)
16,16'/16"—sawteeth, sawtoothed-jaws (left/right)
17,17'—jaw-release apertures
18,18'—replaceable sale-marker (prior-art), insert-tongue portion
19—imprinted indicia
20,20'/20"—flexible-plastic holder pocket, panels thereof (first-panel/second-panel)
21—conventional sales-placard
22—terminus of shorter pocket panel
23—terminus of longer pocket panel
24/24'/24"—sealed-edges (bottom/first-side/second-side)
25,25'/25",25*t*,25X—insert-tab, tab-chamfers(upper/lower), tab-terminus, rigidizing insert
26',26"—retention-jaw release ref.-arrows (left/right)
27—flexural ref.-arrow
28—insertion ref.-arrow
29—entry-relief
30—U-shaped closure-tab
31—V-shaped closure-tab
32—W-shaped closure-tab
33—conventional ZipLock®-closure
34,34'—conventional flap-closure, flap attach-seam
35—rounded pocket-corners
36—abuting-notch

V.) DETAILED DESCRIPTION OF THE PREFERRED EMBODIMENT

The Prior-Art

Initial reference is given by way of the related prior-art of FIGS. 1A & 1B, wherein it is shown a conventional retail-store merchandise-shelf 10 here having a dropped front-edge 11 to which is attached a conventional horizontal-rail like pricing-channel 12 having upper return-flange 12' and lower return-flange 12" which serve to receive engagement of oppositely facing respective clip-paws 14' and 14" of the respective bifurcated-legs 13' and 13" portions according to presently popular spring type display-clip 13 first disclosed in early U.S. Pat. No. 3,530,605.

Note in FIG. 1A how the existing disposable sales-marker 18 has an inward facing insert-tongue 18' which is manually inserted into the receiver-slot 15 having upper terminus 15' and lower terminus 15"; noting that the insert-tongue 18' is staged entirely within the U-shaped confines of the display-clip 13 so that the tongue-terminus 18" is substantially abutting the face of the pricing-channel 12. In FIG. 1B the channel-clip is shown before installation, wherein the two springably folded-in sawtoothed-jaws 16' and 16" interface as to tenaciously pinch-grip upon the insert-tongue 18'; only to be released via FIG. 3 demonstrated simultaneous insertion of a probe like object (represented by action of ref.—arrows 26' and 26") into the left 17' and right ∫" jaw-release apertures. While this technique is quite positive in holding the sales-marker 18, it is also quite often a nuisance of the retail-store merchandise-clerks to deal with (they usually employ the tips of two ball-point pens) as the sales-marker then falls away to the floor where it is then picked-up for subsequent disposal once a sale is over. On the other hand, since the sales-markers are often simply made from approximately 4-inch×5-inch printed slips of paper having no insert-tongue 18', the relatively thin and flimsy body of paper sales-marker becomes easily dislodged from retention-slot 15 as it is frequently brushed against by passing shopping-carts or arms and legs of passing shoppers. The sawtoothed-jaws 16'/16" are not really designed to retain thin paper brand-signs, the prior-art sales-marker 18 with it's insert-tongue 18' is generally made from a single-layer of either semi-rigid cardboard or plastic. Note also, that the commercially available plastic display-clip devices generally do not include the springy jaws 16' and 16"(ref. prior-art FIG. 1B), but rather simply employ similarly opposed sawtoothed-edges 16 formed along the actual receiver-slot 15.

The New-Art

In FIG. 2 is revealed my basic preferred embodiment, preferably including the symmetrically cut 45-degree chamfers 25' and 25" featuring here on my insert-tab 25, which emerge partially external of the existing channel-clip legs 13' and 13", thereby serving (particularly chamfer 25" relative to leg 13") to provide an abutment surface against which the retention-slot terminuses 15 and 15" impinge, when the insert-tab terminus 25*t* is installed as shown with the pocket portion 20 vertical to the merchandise-isle. Owing that the insert-tab portion 25 of my new holder pocket portion 20 is preferably fabricated via die-cutting procedure, the pocket portion 20 in FIG. 2 can be easily made from two layers of ordinary preferably glossy-finish transparent vinyl-plastic 20' and 20" in FIG. 2; while the insert-tab portion 25 is preferably fabricated from a single thicker-gauge layer of substantially more rigid (semi-rigid) clear or opaque plastic. The entire 3-piece die-cut aggregation of plastic pieces 20'/20"/25 are thus easily fused together in a single permanently united formation, generally via the well known electronic ultrasonic-heat boding process. Preferably arranged whereby the shorter panel 20' opening terminus 22 is about 3/16-inch below (see attendant shown dimension—X in FIG. 2) the interfacing longer panel opening terminus 23, although some may prefer instead to simply include a central approximately ¾-inch wide entry-relief of about ¼-inch in just one of the otherwise common length panels, so that the two opposed panels may be likewise more easily fingered apart as to insert a sales-placard 21 interstitially therein.

There remain subtle, however vital other differences which are to become herein more evident and understood as important improvements, for example FIG. 3 shows an upper view of the installation of FIG. 2, revealing how the more flexible quality of the pocket forming panels 20' and 20" allow the pocket portion to easily flex to either side, as is demonstrated via action ref.—arrow 27. Owing that the pricing-channel is generally canted at an approximate 15–20 degree attitude form the vertical, in the plan-view of FIG. 3 the lower channel-rail 12" is seen outset somewhat from it's opposing upper channel-rail 12', as is the outermost-face of the channel-clip 13; while the aggregate holder pocket 20 is arranged perpendicularly outward therefrom.

Reference to FIGS. 4 & 5 shows a sales-placard 21 being inserted interstitially therein the holder pocket portion 20, while the insert-tab portion 25 is shown apart from the pre-existing channel-chip 13. In this example, the two obliquely tapering angles Z' and Z" are combined, but function according to the ref.—angle: Z, as shown in FIG. 5.

A generic-variation of the insert-tab portion is shown in FIG. 5, wherein the outermost terminus configuration **25*t* is a simple basic square-cut configuration; which is also shown in an alternate configuration as defining a ref.—angle: Z tapering slightly (approximately 15–20 degrees) toward the bottom edge of the adjoing pocket portion. This configuration is devised to allow the entire terminus edge 25*t* to impinge abutingly against the retention-slot terminuses 15'/15" as are seen clearly in FIG. 1B; and thereby cause the edges 25*t* (FIG. 2), as to thereby establish the desired substantially perpendicular attitude of the pocket 20 relative to the merchandise-isle floor, owing that the channel-clip 13 (FIG. 2) is generally slightly tilted as is dictated by the cant of the existing pricing-channel 12 (FIG. 1). Note also in FIG. 5 how the sales-placard entry edges 22 and 23 are arranged at the innermost inward-facing edge of the pocket 20**, as another generic-variation embodiment, which entry orientation in of itself tends to obviate need for any additional pocket closure device.

In FIGS. 6A & 6B is depicted still another couple of generic-variation embodiments, wherein FIG. 6A shows an insert-tab having an arched terminus **25*t* preferably formed to an approximate 2-inch radius, which version enables the installer to easily place the pocket 20 at virtually any preferred attitude (perpendicular or otherwise) relative to the floor. An alternate version thereof is shown in FIG. 6B, wherein is also provided a special abuting-notch 36 where the lower edge of the arched terminus makes transition into a straight portion forming an approximate 90-degree angle to the adjoining pocket 20. Note in both FIGS. 6A & 6B that the pocket opening edges 22 and 23 are shown located along the outward-facing portion of the pocket 20**, which is an alternate sales-placard access arrangement preferred by some merchandise-clerk installers; although this orientation really best requires employment of one of the special additional closure devices as is depicted in the following embodiments.

Reference to FIGS. 7A, 7B, 7C & 8, 9, set forth different pocket closure devices, of which the die-cut embodiments 7A,B,C are the most expedient. For example, the FIG. 7A version shows a simple U-shaped die-cut incision 30' which creates a like U-shaped closure-tab 30 which lower terminus is pressed upon sufficiently by the user as to cause the closure-tab to bias over the upper terminus opening edge portion 22' of the pocket as to prevent loss of the enclosed sales-placard, and to generally present a neater appearing installation. The example of FIG. 7B is very similar, except that the die-cut incision 31' provides A V-shaped closure-tab 31, which is likewise biased over the terminus opening edge portion 22'. The example of FIG. 7C is also quite similar to the preceding example, except that here a W-shaped closure-tab arrangement is provided. In FIG. 8, a substantially conventional ZIP-LOCK® closure is provided, which is of the type having no slide-closure device, requiring that the user merely squeeze the opposite panel sides 20' and 20" (FIG. 3) causing the linear-lips of the closure 33 to interlock in a conventional manner. In FIG. 9, is shown a conventional flap-closure portion 34 the upper edge of which is bonded along the top edge 23 of panel 20" (FIG. 3) creating a seam 34', thereby forming a flexile flap 34 which overlaps the opening edge 22.

In any of the preceding insert-tab generic-variations, the insert-tab is preferably approximately 2-inches wide in dimension-Y of FIG. 5, and generally extend outward approximately 1½-inches from the adjoing pocket edge. The insert-tab can also be fabricated as an extension from the double layered pocket portion, wherein is encapsulated an extra piece 25× (FIG. 6A) of more rigid approximately 0.018-inch gauge die-cut sheet-plastic. The pocket's interior measurement is preferably approximately 4-inches wide by about 5-inches deep, however, the pocket portion 20 can be made to any desired size to accommodate various sales-placard sizes.

Thus, it is readily understood how the preferred and generic-variant embodiments of this invention contemplate performing functions in a novel way not heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended Claims set out the scope of the invention sought, and are to be construed as broadly as the terminology therein employed permits, reckoning that the invention verily comprehends every use of which it is susceptible. Accordingly, the embodiments of the invention in which an exclusively property or proprietary privilege is claimed, are defined as follows.

What is claimed is:

1. A reusable display card holder adapted to fit a vertical retention-slot of an existing shelf-face horizontal rail mounting clip, said mounting clip adapted to pinch grip a display card such that the card is viewable on opposite sides thereof, said card holder comprising:

a planar pocket formed of two parallel interfacing quadrilateral layers of flexible transparent plastic material, permanently joined together along three of four sides, the forth side unjoined to provide an opening to the pocket, said pocket including an insert-tab portion extending from one of the sides;

said insert tab portion is adapted to be inserted into said retention-slot so that said pocket extends perpendicularly from the horizontal rail without pinching upon said pocket thereby facilitating easier periodic changing of a display-card thereto; and wherein the insert tab portion is more rigid than the layer of plastic material and wherein the length of the insert tab portion is smaller than the length of the pocket.

2. The holder according to claim 1, wherein said insert-tab is made of a more rigid type plastic material permanently bonded to said planar pocket, thereby facilitating easier insertion into said retention slot; and resisting the rigors of said retention-slot's pinching action.

3. The holder according to claim 1, wherein said insert-tab portion extends from said planar pocket at a joining edge and, including outwardly tapering upper and lower edges forms a leading insertion edge, the said leading insertion-edge of said insert-tab is approximately half the vertical length of the joining edge that is less than the length of said pocket's edge.

4. The holder according to claim 1, wherein said insert-tab portion is formed with a piece of thin and relatively rigid material serving to locally stiffen said inset-tab portion.

5. The holder according to claim 1, the insert tab has an outermost terminus, the outermost terminus of said insert-tab is formed at an angle tapering slightly toward a bottom region of said pocket portion, thereby so that said pocket portion is adapted to stand more perpendicularly to a floor surface of a merchandise-aisle when the outermost terminus portion of said insert tab is installed abutingly into a said existing mounting-clip.

6. The holder according to claim 1, wherein said insert-tab is formed with an arched outermost terminus abutting portion, enabling an user to thereby variably determine an installed attitude of said pocket portion.

7. The holder according to claim 6, wherein said arched portion is an approximate 1-inch radius and includes an abutting-notch where a lower edge of said arched portion makes transition into an abutting-notch portion which forms an approximate 90 degree angle to said pocket portion.

8. The holder according to claim 1, wherein said insert-tab is formed with a squared outermost terminus portion, thereby enabling an attitude of the existing mounting-clip's retention-slot to determine an installed attitude of said pocket portion.

9. The holder according to claim 1, wherein said insert-tab is approximately 2-inches wide and extends outward at a right-angle approximately 1½ inches from said pocket portion, both outermost corners thereof being chamfered to an approximate 45-degree angle and measuring about 1¹⁄₁₆ inch along its said angled edge.

10. The holder according to claim 1, wherein said pocket portion has an interior measurement of approximately 4-inches wide by approximately 5-inches deep.

11. The holder according to claim 1, wherein said pocket portion has an interior measurement width between 2–6 inches and to a depth between 2–9 inches.

12. The holder according to claim 1, wherein said layers of plastic material are arranged along the unjoined side of one of said layers is slightly longer than the other layer, thereby enabling user to more readily spread apart the layers at the opening for access therein.

13. The holder according to claim 12, wherein along the opening the longer of said layer is provided with at least one V-shaped slit closure-tab arranged so that a user can simply press said closure-tab sufficiently so as to cause said closure-tab to bias over the other layer; thereby effectively preventing removal of said display-card.

14. The holder according to claim 12, wherein along the opening the longer of said layer is provided with at least one U-shaped slit closure-tab arranged so that a user can simply press said closure-tab sufficiently so as to cause said closure-tab to bias over the other layer, thereby effectively preventing removal of said display-card.

15. The holder according to claim 12, wherein along the opening the longer of said layer is provided with at least one W-shaped slit closure-tab arranged so that a user can simply press said closure-tab sufficiently so as to cause said closure-tab to bias over the other layer; thereby effectively preventing removal of said display-card.

16. The holder according to claim 1, wherein said unjoined-side is located along an uppermost perimeter portion of said pocket.

17. The holder according to claim 1, wherein said unjoined-side is located along an inwardmost perimeter portion of said pocket.

18. The holder according to claim 1, wherein said unjoined-side is located along an outwardmost perimeter portion of said pocket.

* * * * *